US006948418B2

(12) United States Patent
Kim

(10) Patent No.: US 6,948,418 B2
(45) Date of Patent: Sep. 27, 2005

(54) HERMETIC RECIPROCATING COMPRESSOR

(75) Inventor: Jin Ug Kim, Kwangju (KR)

(73) Assignee: Samsung Gwangju Electronics Co., Ltd., Kwangju (KR)

( * ) Notice: Subject to any disclaimer, the term of this patent is extended or adjusted under 35 U.S.C. 154(b) by 32 days.

(21) Appl. No.: 10/628,666

(22) Filed: Jul. 28, 2003

(65) Prior Publication Data

US 2004/0221716 A1 Nov. 11, 2004

(30) Foreign Application Priority Data

May 9, 2003 (KR) ..... 10-2003-0029489

(51) Int. Cl.[7] ..... F01B 9/00
(52) U.S. Cl. ..... 92/140; 417/415
(58) Field of Search ..... 92/140, 72, 74, 92/76; 417/415, 579 E

(56) References Cited

U.S. PATENT DOCUMENTS 2,463,766 A * 3/1949 Hadley ..... 92/140
4,718,830 A * 1/1988 Middleton et al. ..... 417/372
4,836,755 A * 6/1989 Nitsche et al. ..... 417/368
5,205,723 A * 4/1993 Kawai et al. ..... 417/415
5,795,140 A 8/1998 Jin ..... 417/372
6,095,768 A * 8/2000 Bianchi ..... 417/415
6,357,338 B2 * 3/2002 Montgomery ..... 92/140

* cited by examiner

*Primary Examiner*—Edward K. Look
*Assistant Examiner*—Igor Kershteyn
(74) *Attorney, Agent, or Firm*—Ladas & Parry

(57) ABSTRACT

A hermetic reciprocating compressor, in which a bearing structure to support a rotating shaft is improved to minimize frictional contact between the parts of the compressor, thus reducing noise of the compressor and improving compression efficiency of the compressor. In the hermetic reciprocating compressor, a first annular bearing seat is formed around an upper edge of a shaft bore of a frame to seat therein a first radial bearing which sustains loads of a rotating shaft. The first radial bearing is a self-aligning radial bearing which allows the rotating shaft to self-align due to a clearance angle of the first radial bearing, even when a desired perpendicular arrangement of the shaft bore relative to a cylinder block is not formed, due to a mechanical tolerance of the frame. The first radial bearing sustains both axial loads of the rotating shaft and horizontal loads acting in the rotating shaft due to rectilinear reciprocation of a piston, thus reducing the losses caused by friction between the rotating shaft and the frame. In addition, since the rotating shaft self-aligns due to the first radial bearing, it is possible to reduce the losses caused by friction between a compression chamber and the piston and between the rotating shaft and the frame.

18 Claims, 9 Drawing Sheets

HERMETIC RECIPROCATING COMPRESSOR

CROSS-REFERENCE TO RELATED APPLICATION

This application claims the benefit of Korean Application No. 2003-29489, filed May 9, 2003, in the Korean Intellectual Property Office, the disclosure of which is incorporated herein by reference.

BACKGROUND OF THE INVENTION

1. Field of the Invention

The present invention relates, in general, to hermetic compressors and, more particularly, to a hermetic reciprocating compressor which uses a radial bearing capable of smoothly operating the parts of the compressor.

2. Description of the Related Art

Generally, compressors are machines that compress a substance, such as a gas refrigerant, to reduce a volume of the substance or change a phase of the substance. As an example of the compressors, hermetic reciprocating compressors, which are housed in hermetic casings and in which a rotation of a shaft is converted into a rectilinear reciprocation of a piston within a compression chamber, are typically used in refrigeration systems to compress a gas refrigerant, prior to discharging the compressed refrigerant to a condenser.

In conventional hermetic reciprocating compressors, the hermetic casing is fabricated with upper and lower casing parts assembled into a single body. A compression unit to compress the inlet gas refrigerant, and a drive unit to generate a drive power for the compression unit are installed in the hermetic casing.

In the conventional hermetic reciprocating compressors, the compression unit has a cylinder block, which is integrally formed in a frame and defines a compression chamber therein. A cylinder head is mounted to the cylinder block. The cylinder head has both a suction chamber to guide the gas refrigerant into the compression chamber, and an exhaust chamber to guide the compressed refrigerant from the compression chamber to an outside of the hermetic casing. A piston is received in the compression chamber to perform a rectilinear reciprocation in the compression chamber.

The drive unit is provided at a position under the compression unit, and includes a stator along which an electromagnetic field is generated when electricity is supplied to the stator. The drive unit also has a rotor, which rotates by the electromagnetic field generated along the stator, and a rotating shaft axially and securely penetrating a center of the rotor to rotate along with the rotor.

The rotating shaft axially passes a shaft bore formed in the frame, and an eccentric part having an eccentric shaft is provided at an upper portion of the rotating shaft. A thrust bearing is installed at a junction between the eccentric part of the rotating shaft and the frame so as to sustain axial loads, which act in the rotating shaft due to the weight of the rotating shaft.

A lower oil path is formed in a lower section of the rotating shaft, such that the lower oil path extends from a lower end to an intermediate portion of the rotating shaft. In such a case, an upper end of the lower oil path reaches a position level with a lower end of the frame. That is, the upper end of the lower oil path is terminated at a position corresponding to a lower end of a contact surface of the rotating shaft relative to the frame. A spiral oil groove is formed around a part of an outer surface of the rotating shaft such that the spiral oil groove is connected at a lower end thereof to the upper end of the lower oil path and is connected at an upper end thereof to an upper oil path formed in the eccentric part of the rotating shaft. Therefore, when the rotating shaft rotates, oil is drawn upward from a bottom of the hermetic casing while orderly flowing through the lower oil path, the spiral oil groove, and the upper oil path. The contact surfaces of the rotating shaft relative to the frame and the thrust bearing are lubricated. That is, an oil layer is formed on each of the contact surfaces of the rotating shaft relative to the frame and the thrust bearing, so that the rotating shaft rotates smoothly.

However, the conventional hermetic reciprocating compressors are problematic as follows. That is, since the thrust bearing sustains only axial loads acting in the rotating shaft due to the weight of the rotating shaft, the rotating shaft is held with friction within the shaft bore of the frame.

Since the rotating shaft is held with friction within the shaft bore as described above, the rotating shaft may undesirably move in the shaft bore. In such a case, severe friction occurs at the junction between the rotating shaft and the shaft bore of the frame. The conventional hermetic reciprocating compressors thus easily generate noise to upset those around the compressors. The frictional contact of the rotating shaft with the shaft bore of the frame also undesirably reduces compression efficiency of the compressors.

In addition, the spiral oil groove must be formed around the outer surface of the rotating shaft in an effort to lubricate the junction between the rotating shaft and the shaft bore of the frame to avoid frictional contact of the rotating shaft with the shaft bore. However, the machining of the spiral oil groove around the rotating shaft complicates a production process of the compressors. Furthermore, it is difficult to machine the spiral oil groove around the outer surface of the rotating shaft.

The cylinder block integrally formed in the frame and the shaft bore of the frame must be arranged such that the cylinder block is always perpendicular to the shaft bore. However, the conventional hermetic reciprocating compressors may not always form the desired perpendicular arrangement of the shaft bore relative to the cylinder block, due to a mechanical tolerance of the frame. In such a case, severe friction occurs at the junction between the rotating shaft and the shaft bore to cause excessive wear on the rotating shaft and the shaft bore, in addition to generating noise.

SUMMARY OF THE INVENTION

Accordingly, it is an aspect of the present invention to provide a hermetic reciprocating compressor, in which a bearing structure to support a rotating shaft is improved to minimize frictional contact between parts of the compressor, thus reducing noise of the compressor and improving compression efficiency of the compressor.

Additional aspects and advantages of the invention will be set forth in part in the description which follows and, in part, will be obvious from the description, or may be learned by practice of the invention.

The foregoing and other aspects of the present invention are achieved by providing a hermetic reciprocating compressor, including: a rotating shaft provided with an eccentric part at an upper portion thereof; a drive unit to rotate the rotating shaft; a frame having a shaft bore to receive the rotating shaft therein, with a first annular bearing seat formed around an upper edge of the shaft bore; a cylinder block provided at an upper portion of the frame to define a compression chamber therein; a piston received in the compression chamber to perform a rectilinear reciprocation in the compression chamber so as to compress a refrigerant, in response to a rotation of the eccentric part of the rotating shaft; and a first radial bearing seated in the first annular bearing seat of the frame to sustain both axial loads of the rotating shaft and horizontal loads acting in the rotating shaft due to the rectilinear reciprocation of the piston, the first radial bearing having a first outer race supported by the frame and a first inner race set around the rotating shaft.

The foregoing and other aspects of the present invention are also achieved by providing a hermetic reciprocating compressor, including: a rotating shaft provided with an eccentric part at an upper portion thereof; a drive unit to rotate the rotating shaft; a frame having a shaft bore to receive the rotating shaft therein, with a first annular bearing seat formed around an upper edge of the shaft bore; a cylinder block provided at an upper portion of the frame to define a compression chamber therein; a piston received in the compression chamber to perform a rectilinear reciprocation in the compression chamber so as to compress a refrigerant, in response to a rotation of the eccentric part of the rotating shaft; a first radial bearing seated in the first annular bearing seat of the frame to sustain both axial loads of the rotating shaft and horizontal loads acting in the rotating shaft due to the rectilinear reciprocation of the piston, the first radial bearing having a first outer race supported by the frame and a first inner race set around the rotating shaft; a second annular bearing seat formed around a lower edge of the shaft bore; and a second radial bearing seated in the second annular bearing seat, the second radial bearing having a second outer race supported by the frame and a second inner race set around the rotating shaft.

The foregoing and other aspects of the present invention are also achieved by providing a hermetic reciprocating compressor, including: a rotating shaft provided with an eccentric shaft; a drive unit to rotate the rotating shaft; a cylinder block provided with a compression chamber therein to compress a refrigerant in the compression chamber; a piston received in the compression chamber to perform a rectilinear reciprocation in the compression chamber so as to compress the refrigerant; a connecting rod having a shaft guide at a first end thereof to be rotatably connected at the shaft guide to the eccentric shaft of the rotating shaft, and connected to the piston at a second end thereof, so that the connecting rod converts an eccentric rotation of the eccentric part into the rectilinear reciprocation of the piston; and a third radial bearing set in a junction between an outer surface of the eccentric shaft and an inner surface of the shaft guide of the connecting rod.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
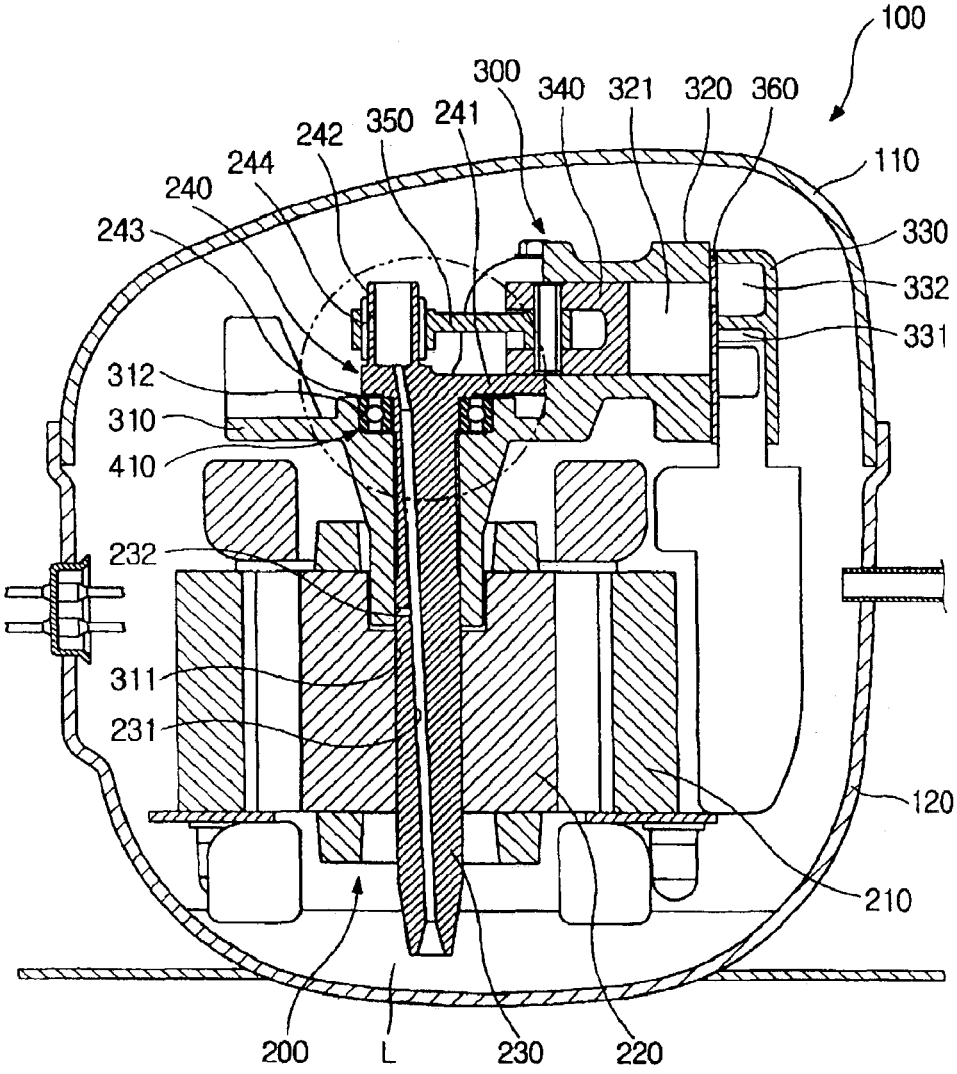
FIG. 1 is a side sectional view showing the construction of a hermetic reciprocating compressor, according to a first embodiment of the present invention.

Reference will now be made in detail to the present preferred embodiments of the present invention, examples of which are illustrated in the accompanying drawings, wherein like reference numerals refer to like elements throughout.

FIG. 1 is a side sectional view showing the construction of a hermetic reciprocating compressor, according to a first embodiment of the present invention.

As shown in FIG. 1, the hermetic reciprocating compressor according to the first embodiment of the present invention has a hermetic casing 100 which is fabricated with upper and lower casing parts 110 and 120 assembled into a hermetic single body. A compression unit 300 to compress an inlet gas refrigerant, and a drive unit 200 to generate a drive power for the compression unit 300 are installed in the hermetic casing 100.

In the hermetic reciprocating compressor, the compression unit 300 has a cylinder block 320, which is integrally formed in a frame 310 to define a compression chamber 321 therein. A cylinder head 330 is mounted to the cylinder block 320. The cylinder head 330 has both a suction chamber 331 to guide the gas refrigerant into the compression chamber 321, and an exhaust chamber 332 to guide the compressed refrigerant from the compression chamber 321 to an outside of the hermetic casing 100. A piston 340 is received in the compression chamber 321 to perform a rectilinear reciprocation in the compression chamber 321 in response to a rotation of a rotating shaft 230.

The compression unit 300 also has a valve unit 360, which is provided at a junction between the cylinder block 320 and the cylinder head 330. The valve unit 360 has a suction valve plate to control the flow of the refrigerant into the compression chamber 321, and an exhaust valve plate to control the flow of the refrigerant from the compression chamber 321.

The drive unit 200 is provided at a position under the compression unit 300, and includes a stator 210 along which an electromagnetic field is generated when electricity is supplied to the stator 210. The drive unit 200 also has a rotor 220, which rotates by the electromagnetic field generated along the stator 210. The rotating shaft 230 axially and securely penetrates a center of the rotor 220 to rotate along with the rotor 220.

The rotating shaft 230 axially passes a shaft bore 311 formed in the frame 310, and an eccentric part 240 is provided at an upper portion of the rotating shaft 230 to rotate eccentrically when the rotating shaft 230 rotates. The eccentric part 240 has a balance weight 241 which keeps the balance of the eccentric part 240 during the rotation of the eccentric part 240. An eccentric shaft 242 having a predetermined length is provided at an upper end of the balance weight 241. The eccentric part 240 also has a bearing support 243 at a lower surface thereof to be supported by a first radial bearing 410, as will be described in detail later herein. The eccentric shaft 242 is connected to the piston 340 through a connecting rod 350, so that the eccentric rotation of the eccentric shaft 242 is converted into a rectilinear reciprocation of the piston 340 within the compression chamber 321.

In order to support the rotation of the rotating shaft 230 in the shaft bore 311 of the frame 310 by use of the first radial bearing 410, a first annular bearing seat 312 is formed around an upper edge of the shaft bore 311 to seat the first radial bearing 410 therein. The rotating shaft 230 has a stepped part at a predetermined section of an outer surface thereof so as to secure a gap between the outer surface of the rotating shaft 230 and an inner surface of the shaft bore 311. That is, the stepped part of the rotating shaft 230, having a reduced diameter, extends downward from a position aligned with a lower surface of the first radial bearing 410 to a predetermined lower position of the rotating shaft 230. The rotating shaft 230 is supported, in a sliding contact manner, by a lower portion of the shaft bore 311.

An oil path 231 is longitudinally formed in the rotating shaft 230, such that the oil path 231 extends from a lower end of the rotating shaft 230 to the eccentric part 240, thus guiding oil "L" from a bottom of the hermetic casing 100 to the eccentric part 240. An oil outlet hole 232 is formed in the rotating shaft 230 at a predetermined position where the rotating shaft 230 is in sliding contact With the lower portion of the shaft bore 311. The oil outlet hole 232 communicates with the oil path 231, thus feeding the oil from the oil path 231 to a junction of the outer surface of the rotating shaft 230 and the lower portion of the shaft bore 311. An oil outlet port 244 is formed in the eccentric shaft 242 of the eccentric part 240 at a predetermined position. The oil outlet port 244 communicates with the oil path 231, and feeds the oil from the oil path 231 to a junction of an outer surface of the eccentric shaft 242 and a shaft guide of the connecting rod 350.

Figure 2:
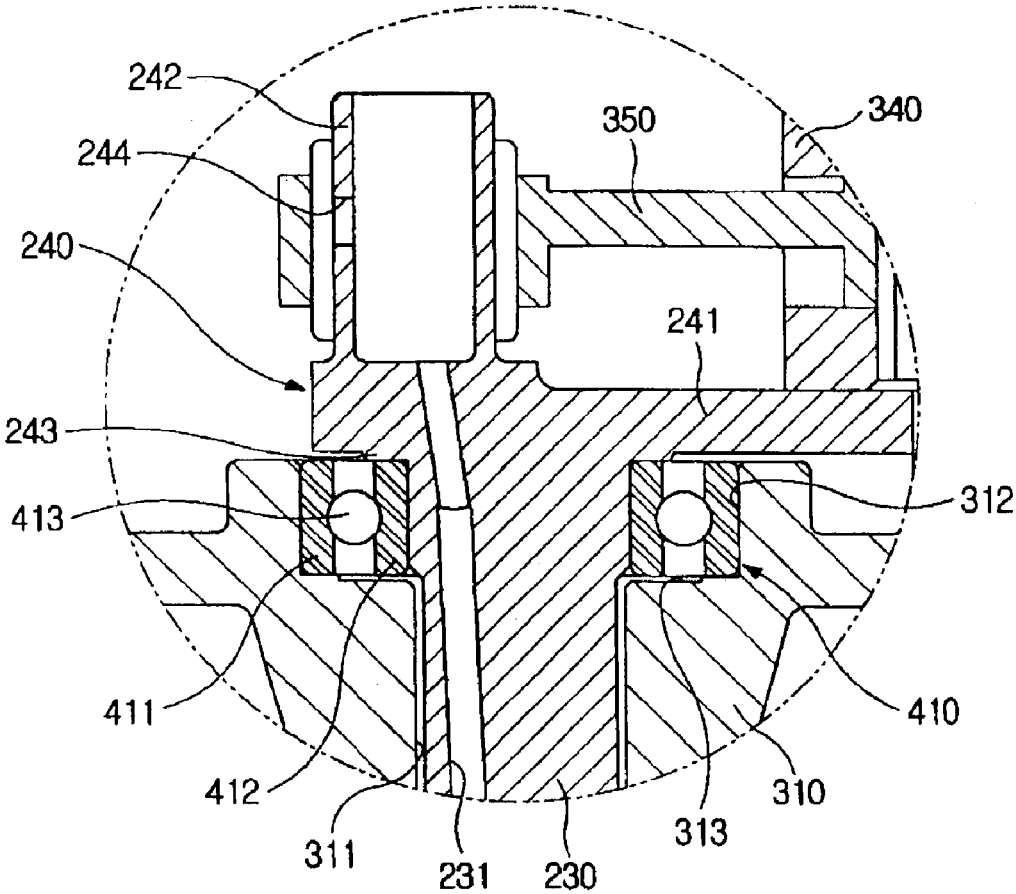
FIG. 2 is a sectional view showing the construction of a first radial bearing included in the hermetic reciprocating compressor of FIG. 1.

FIG. 2 is a sectional view showing the construction of the first radial bearing 410 of the hermetic reciprocating compressor, according to the first embodiment of the present invention.

As shown in FIG. 2, the first radial bearing 410 has a first outer race 411 and a first inner race 412 which are concentric rings, with a plurality of first balls 413 set in a ball seat space defined between the outer and inner races 411 and 412. The first outer race 411 is securely fitted in the bearing seat 312 of the frame 310, while the first inner race 412 is set with friction around the rotating shaft 230.

An upper surface of the first inner race 412 which is set with friction around the rotating shaft 230 is in close contact with the bearing support 243 which is a protrusion formed on the lower surface of the eccentric part 240. A first spacing depression 313 is formed on a bottom surface of the bearing seat 312, such that a lower surface of the first inner race 412 is slightly spaced apart from the depressed bottom surface of the bearing seat 312.

As described above, the first inner race 412 is set around the rotating shaft 230 with friction, such that the rotating shaft 230 may move relative to the first inner race 412, as desired, when the rotating shaft 230 is rotated by force relative to the first inner race 412. The first outer race 411 is securely fitted in the bearing seat 312 of the frame 310. Due to the frictional contact of the first inner race 412 with the rotating shaft 230, the first inner race 412 rotates along with the rotating shaft 230 without slipping, during the rotation of the rotating shaft 230. Therefore, the first radial bearing 410 thus supports the rotating shaft 230 while allowing the rotating shaft 230 to freely rotate relative to the frame 310. In the present invention, it should be understood that the first inner race 412 may be securely fitted over the rotating shaft 230, while the first outer race 411 may be set in the bearing seat 312 of the frame 310 with friction, such that the first outer race 411 may move relative to the bearing seat 312, as desired, when the first outer race 411 is rotated by force relative to the bearing seat 312.

In the first embodiment of the present invention, the first radial bearing 410 is designed as a self-aligning radial bearing which allows the rotating shaft 230 to self-align due to a clearance angle of the first radial bearing 410, even when the desired perpendicular arrangement of the shaft bore 311 relative to the cylinder block 320 of the frame 310 is not formed, due to a mechanical tolerance of the frame 310.

The operational effect of the hermetic reciprocating compressor having the first radial bearing 410 with the above-described construction will be described herein below.

When electricity is supplied to the hermetic compressor, an electromagnetic field is generated along the stator 210 of the drive unit 200. The rotor 220 with the rotating shaft 230 thus rotates by the electromagnetic field generated along the stator 210. Therefore, the eccentric shaft 242 rotates along with the rotating shaft 230, and the piston 340, connected to the eccentric shaft 242 through the connecting rod 350, rectilinearly reciprocates in the compression chamber 321. The gas refrigerant is thus drawn into the compression chamber 321 so as to be compressed, prior to being discharged from the compression chamber 321 to the outside of the hermetic casing 100.

During the operation of the hermetic reciprocating compressor, the first radial bearing 410 sustains both the axial loads acting in the rotating shaft 230 due to the weight of the rotating shaft 230 and horizontal loads acting in the rotating shaft 230 due to the rectilinear reciprocation of the piston 340. The first radial bearing 410 thus reduces the losses caused by friction between the rotating shaft 230 and the frame 310.

In addition, even when the desired perpendicular arrangement of the shaft bore 311 of the frame 310 relative to the cylinder block 320 is not formed due to a mechanical tolerance of the frame 310, the rotating shaft 230 effectively self-aligns due to the clearance angle of the first radial bearing 410 which is the self-aligning radial bearing. Therefore, the first radial bearing 410 further reduces the losses caused by friction between the compression chamber 321 and the piston 340 and between the rotating shaft 230 and the frame 310.

The hermetic reciprocating compressor of the present invention is thus improved in the compression efficiency thereof, and reduces noise caused by friction between the parts of the compressor.

Figure 3:
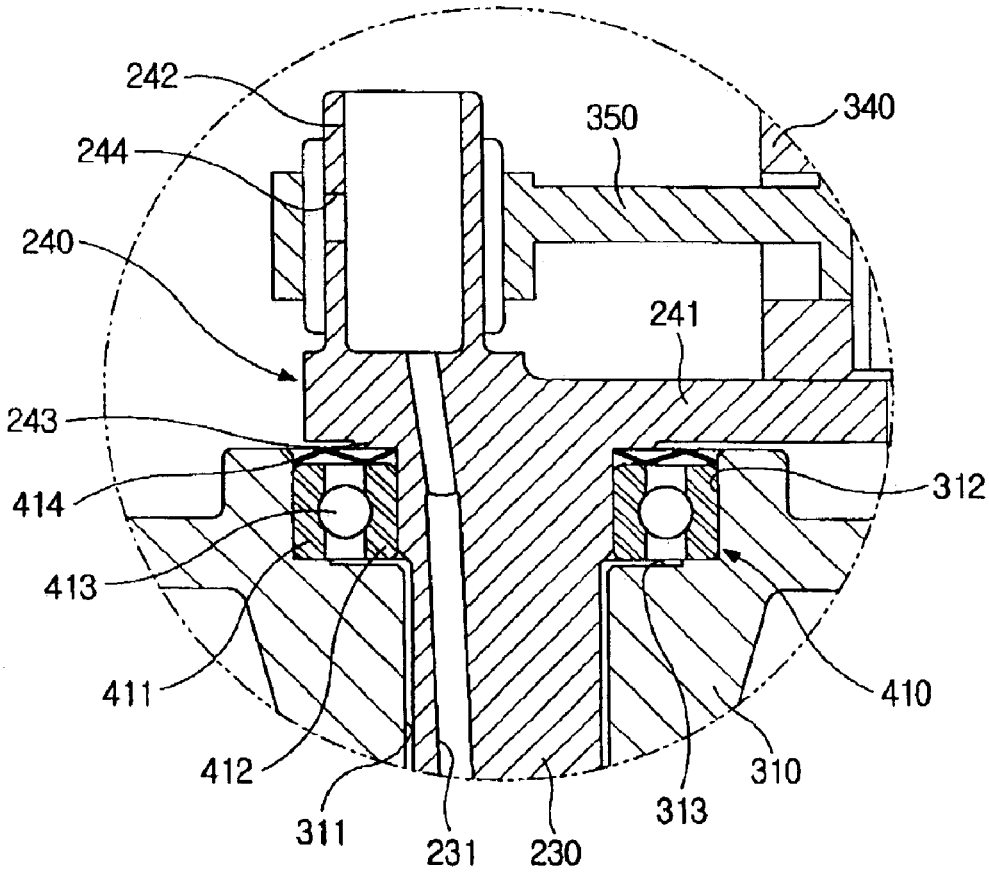
FIG. 3 is a sectional view showing the construction of a first radial bearing, according to a first modification of the first embodiment of the present invention.

FIG. 3 is a sectional view showing the construction of a first radial bearing, according to a first modification of the first embodiment of the present invention. In the following description for the first modification of the first embodiment, those elements common to both the first embodiment of FIGS. 1 and 2 and the first modification of FIG. 3 will thus carry the same reference numerals, and further explanation for the elements is not deemed necessary.

As shown in FIG. 3, in the first modification of the first embodiment of the present invention, the first radial bearing 410 is seated in the bearing seat 312 of the frame 310. In such a case, the first outer race 411 is securely fitted in the bearing seat 312, while the first inner race 412 is set around the rotating shaft 230 with friction such that the rotating shaft 230 may move relative to the first inner race 412, as desired, when the rotating shaft 230 is rotated by force relative to the first inner race 412.

A first upper spring washer 414 having a predetermined elasticity is set in a junction between the upper surface of the first inner race 412 and the lower surface of the bearing support 243. The first upper spring washer 414 elastically supports the rotating shaft 230 so as to reduce axial loads acting in the rotating shaft 230.

Due to the first upper spring washer 414, the rotating shaft 230 and the rotor 220 of the drive unit 200 (see FIG. 1) are movable within a predetermined vertical range. Therefore, the rotor 220 self-aligns by the electromagnetic field generated along the stator 210, such that the rotor 220 is exactly aligned with the stator 210.

Figure 4:
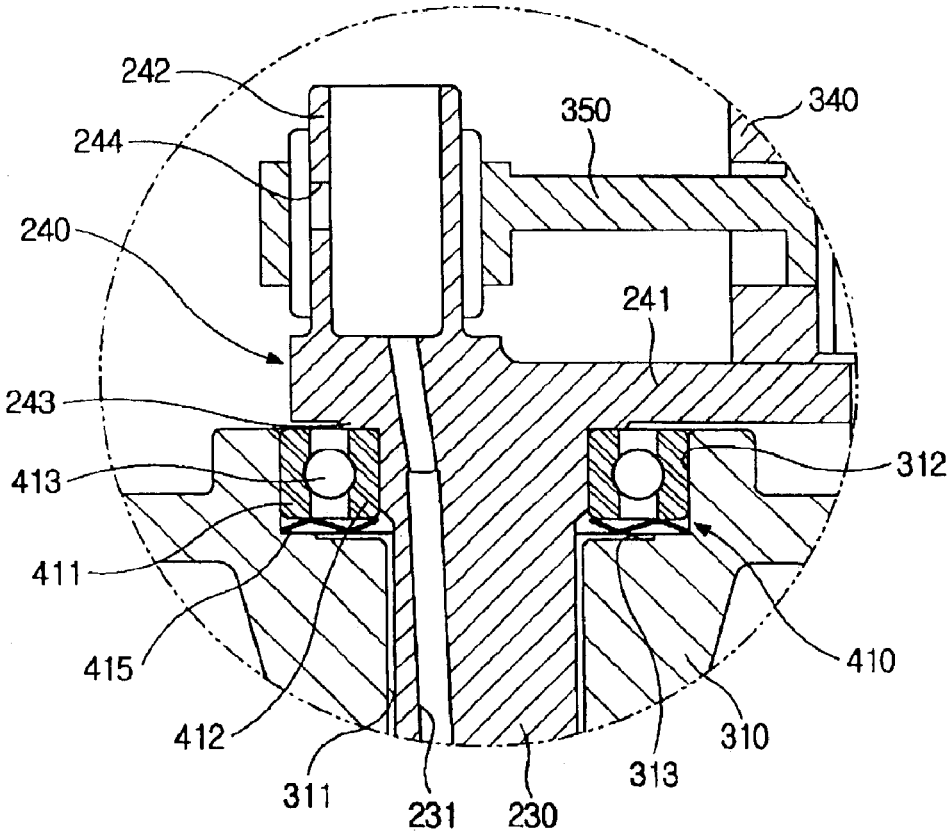
FIG. 4 is a sectional view showing the construction of a first radial bearing, according to a second modification of the first embodiment of the present invention.

FIG. 4 is a sectional view showing the construction of a first radial bearing, according to a second modification of the first embodiment of the present invention. In the following description for the second modification of the first embodiment, those elements common to both the first embodiment of FIGS. 1 and 2 and the second modification of FIG. 4 will thus carry the same reference numerals, and further explanation for the elements is not deemed necessary.

As shown in FIG. 4, in the second modification of the first embodiment of the present invention, the first radial bearing 410 is seated in the bearing seat 312 of the frame 310. In such a case, the first inner race 412 is securely fitted over the rotating shaft 230, while the first outer race 411 is installed with friction in the bearing seat 312 such that the first outer race 411 may move relative to the rotating shaft 230, as desired, when the first outer race 411 is rotated by force relative to the bearing seat 312.

A first lower spring washer 415 having a predetermined elasticity is set in a junction between the lower surface of the first outer race 411 and the bottom surface of the bearing seat 312. The first lower spring washer 415 elastically supports both the rotating shaft 230 and the first radial bearing 410, thus reducing axial loads acting in the rotating shaft 230.

Due to the first lower spring washer 415, the rotating shaft 230 and the rotor 220 of the drive unit 200 (see FIG. 1) are movable within a predetermined vertical range. Therefore, the rotor 220 self-aligns by the electromagnetic field generated along the stator 210, such that the rotor 220 is exactly aligned with the stator 210.

Figure 5:
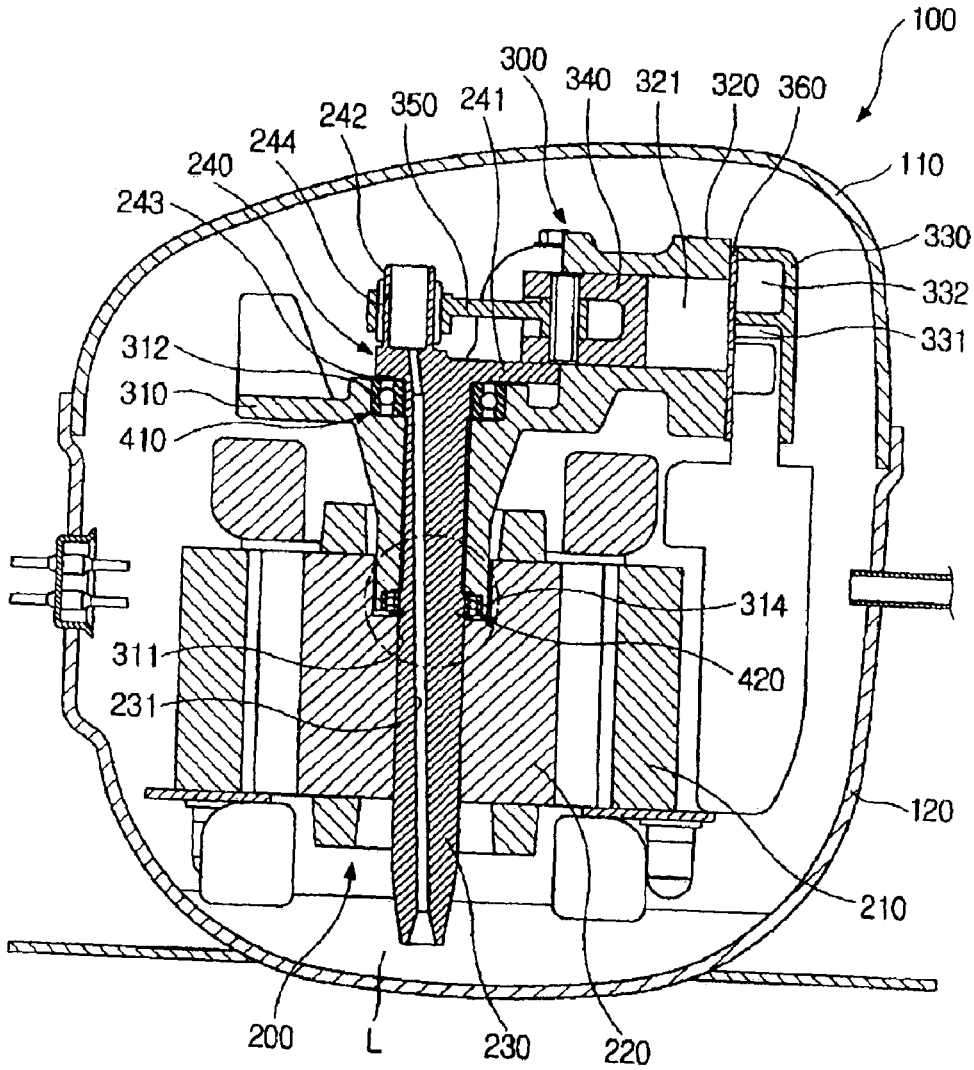
FIG. 5 is a side sectional view showing the construction of a hermetic reciprocating compressor, according to a second embodiment of the present invention.
Figure 6:
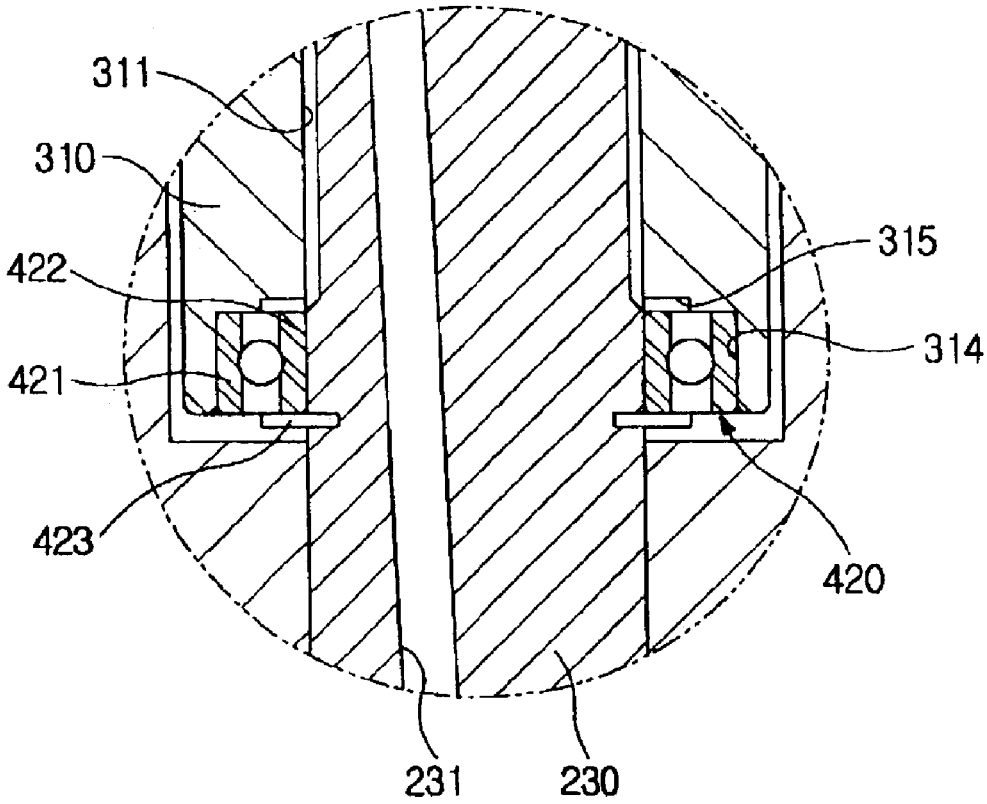
FIG. 6 is a sectional view showing the construction of a second radial bearing included in the hermetic reciprocating compressor of FIG. 5.

FIG. 5 is a side sectional view showing the construction of a hermetic reciprocating compressor, according to a second embodiment of the present invention. FIG. 6 is a sectional view showing the construction of a second radial bearing included in the hermetic reciprocating compressor of FIG. 5. In the following description for the second embodiment, those elements common to both the first embodiment of FIGS. 1 and 2 and the second embodiment of FIGS. 5 and 6 will thus carry the same reference numerals, and further explanation for the elements is not deemed necessary.

As shown in FIGS. 5 and 6, the hermetic reciprocating compressor according to the second embodiment of the present invention includes a second radial bearing 420, in addition to the first radial bearing 410. The second radial bearing 420 is seated in a second annular bearing seat 314 which is formed around a lower edge of the shaft bore 311. The second radial bearing 420 has a second outer race 421 and a second inner race 422 which are concentric rings, with a plurality of second balls set in a ball seat space defined between the outer and inner races 421 and 422. The second outer race 421 is securely fitted in the second bearing seat 314 of the frame 310, while the second inner race 422 is set around the rotating shaft 230 with friction.

The rotating shaft 230 has a stepped part at a predetermined section of an outer surface thereof so as to secure a gap between the outer surface of the rotating shaft 230 and the inner surface of the shaft bore 311. The stepped part of the rotating shaft 230 extends upward from the second bearing seat 314. An oil path 231 is longitudinally formed in the rotating shaft 230, such that the oil path 231 extends from the lower end of the rotating shaft 230 to the eccentric part 240, thus guiding oil "L" from the bottom of the hermetic casing 100 to the eccentric part 240. An oil outlet port 244 is formed in the eccentric shaft 242 of the eccentric part 240 so as to communicate with the oil path 231, thus feeding the oil from the oil path 231 to the junction of the outer surface of the eccentric shaft 242 and the shaft guide of the connecting rod 350.

A stop ring 423 is fitted around the rotating shaft 230 to support a lower surface of the second inner race 422 of the second radial bearing 420. A second spacing depression 315 is formed on an upper surface of the second bearing seat 314, such that an upper surface of the second inner race 422 is slightly spaced apart from the depressed upper surface of the second bearing seat 314. In the second embodiment of the present invention, the second radial bearing 420 is designed as a self-aligning radial bearing which allows the rotating shaft 230 to self-align due to a clearance angle of the second radial bearing 420, even when the desired perpendicular arrangement of the shaft bore 311 relative to the cylinder block 320 of the frame 310 is not formed, due to the mechanical tolerance of the frame 310.

The hermetic reciprocating compressor with the first and second radial bearings 410 and 420 according to the second embodiment of the present invention prevents the rotating shaft 230 from coming into sliding contact with the shaft bore 311 of the frame 310, thus preventing wear on the rotating shaft 230 or on the shaft bore 311. In addition, since the rotating shaft 230 self-aligns due to the second radial bearing 420, it is possible to reduce the losses caused by friction between the compression chamber 321 and the piston 340, and between the rotating shaft 230 and the frame 310.

Figure 7:
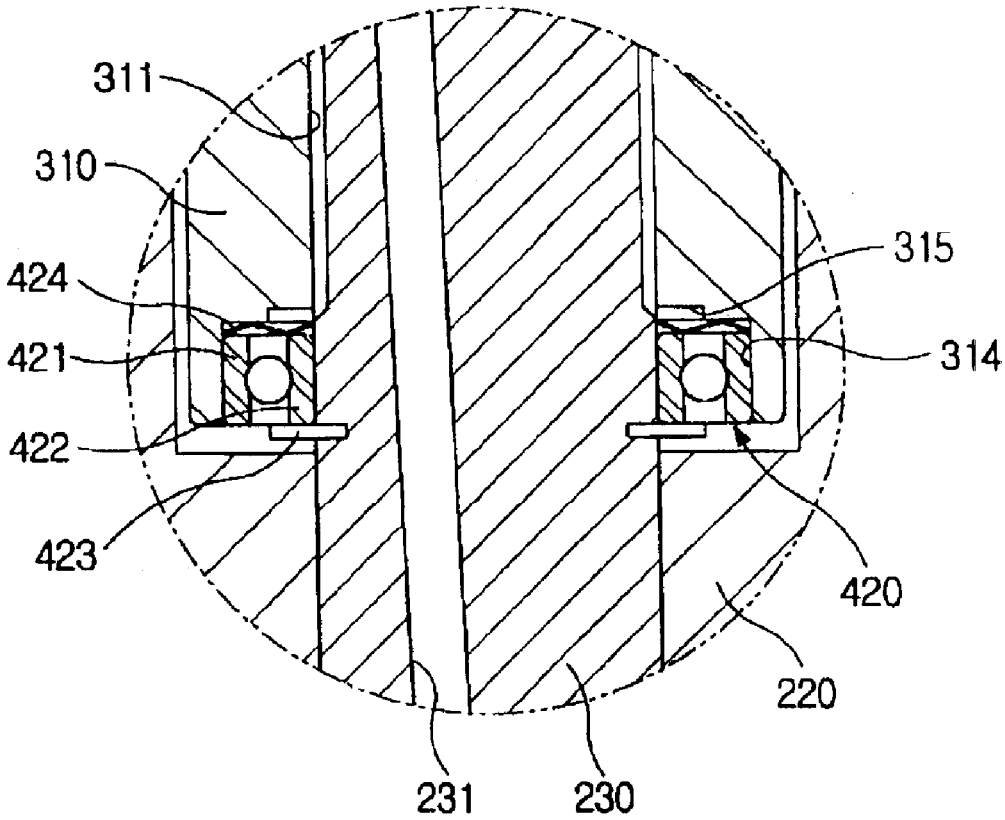
FIG. 7 is a sectional view showing the construction of a second radial bearing, according to a modification of the second embodiment of the present invention.

FIG. 7 is a sectional view showing the construction of a second radial bearing, according to a modification of the second embodiment of the present invention. In the following description for the modification of the second embodiment, those elements common to both the second embodiment of FIGS. 5 and 6 and the modification of FIG. 7 will thus carry the same reference numerals, and further explanation for the elements is not deemed necessary.

As shown in FIG. 7, a second spring washer 424 having a predetermined elasticity is set in a junction between the upper surface of the second outer race 421 of the second radial bearing 420 and the upper surface of the second bearing seat 314.

The second spring washer 424 elastically supports the rotating shaft 230 so as to reduce axial loads acting in the rotating shaft 230.

Due to the second spring washer 424, the rotating shaft 230 and the rotor 220 of the drive unit 200 (see FIG. 5) are movable within a predetermined vertical range. Therefore, the rotor 220 self-aligns by the electromagnetic field generated along the stator 210, such that the rotor 220 is exactly aligned with the stator 210.

Figure 8:
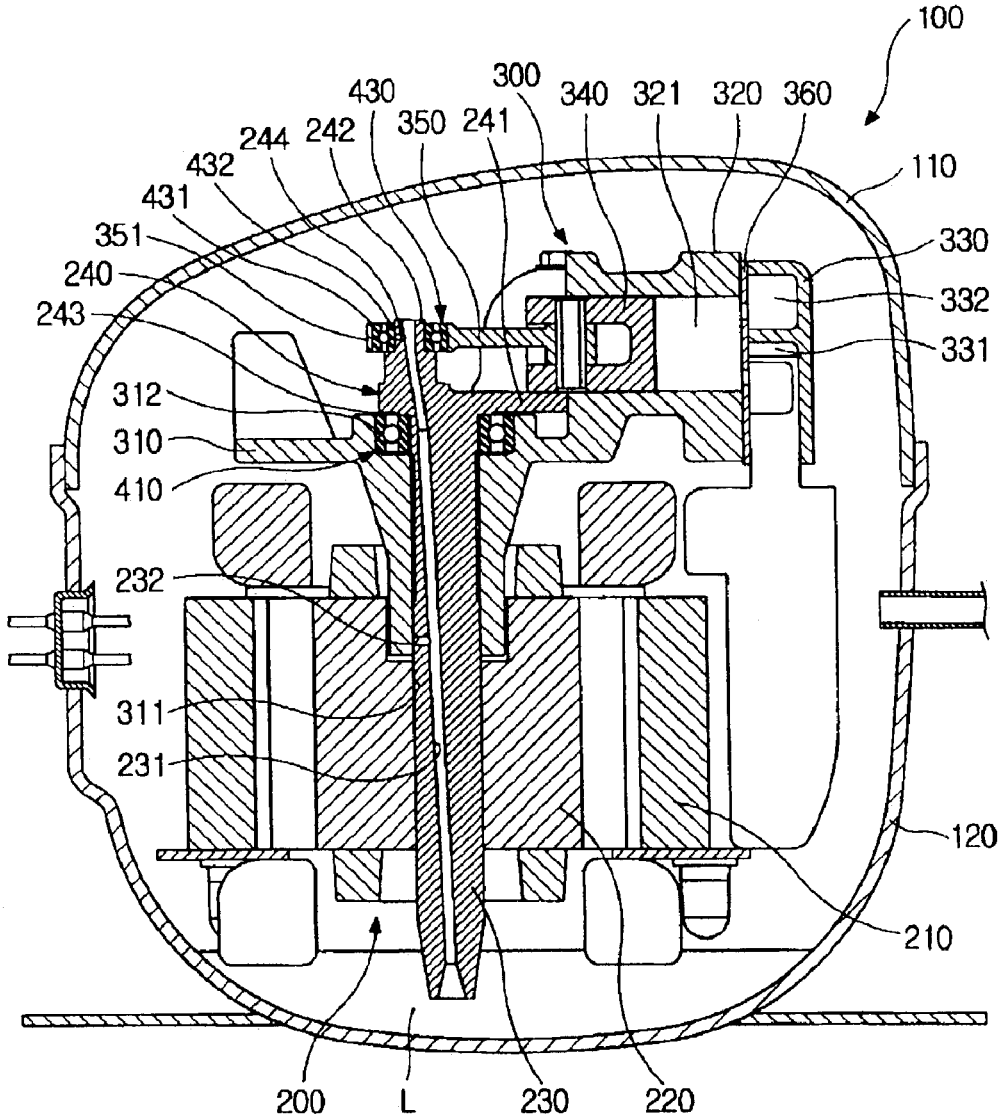
FIG. 8 is a side sectional view showing the construction of a hermetic reciprocating compressor, according to a third embodiment of the present invention.

FIG. 8 is a side sectional view showing the construction of a hermetic reciprocating compressor, according to a third embodiment of the present invention. In the following description for the third embodiment, those elements common to both the first embodiment of FIGS. 1 and 2 and the third embodiment of FIG. 8 will thus carry the same reference numerals, and further explanation for the elements is not deemed necessary.

In the hermetic reciprocating compressor according to the third embodiment of the present invention, the eccentric shaft 242 of the eccentric part 240 of the rotating shaft 230 is connected to the piston 340 through the connecting rod 350, so that the eccentric rotation of the eccentric shaft 242 is converted into the rectilinear reciprocation of the piston 340 within the compression chamber 321. In such a case, the connecting rod 350 has a shaft guide 351 at a first end thereof to be rotatably connected at the shaft guide 351 to the eccentric shaft 242, and is connected to the piston 340 at a second end thereof.

The hermetic reciprocating compressor according to the third embodiment has a third radial bearing 430, in addition to the first radial bearing 410. The third radial bearing 430 is set in a junction between the outer surface of the eccentric shaft 242 and the shaft guide 351 of the connecting rod 350. The third radial bearing 430 has a third outer race 431 and a third inner race 432 which are concentric rings, with a plurality of third balls set in a ball seat space defined between the outer and inner races 431 and 432. The third outer race 431 is securely fitted in the shaft guide 351 of the connecting rod 350, while the third inner race 432 is set around the eccentric shaft 242 with friction.

The third radial bearing 430 is designed as a self-aligning radial bearing which allows the rotating shaft 230 to self-align due to a clearance angle of the third radial bearing 430, even when a desired perpendicular arrangement of the shaft bore 311 relative to the compression chamber 321 of the cylinder block 320 is not formed, due to a mechanical tolerance of the frame 310.

The third radial bearing 430 reduces friction between the eccentric shaft 242 and the shaft guide 351 of the connecting rod 350. In addition, since the third radial bearing 430 is the self-aligning radial bearing, it is possible to reduce the losses caused by friction between the compression chamber 321 and the piston 340 and between the rotating shaft 230 and the frame 310.

Figure 9:
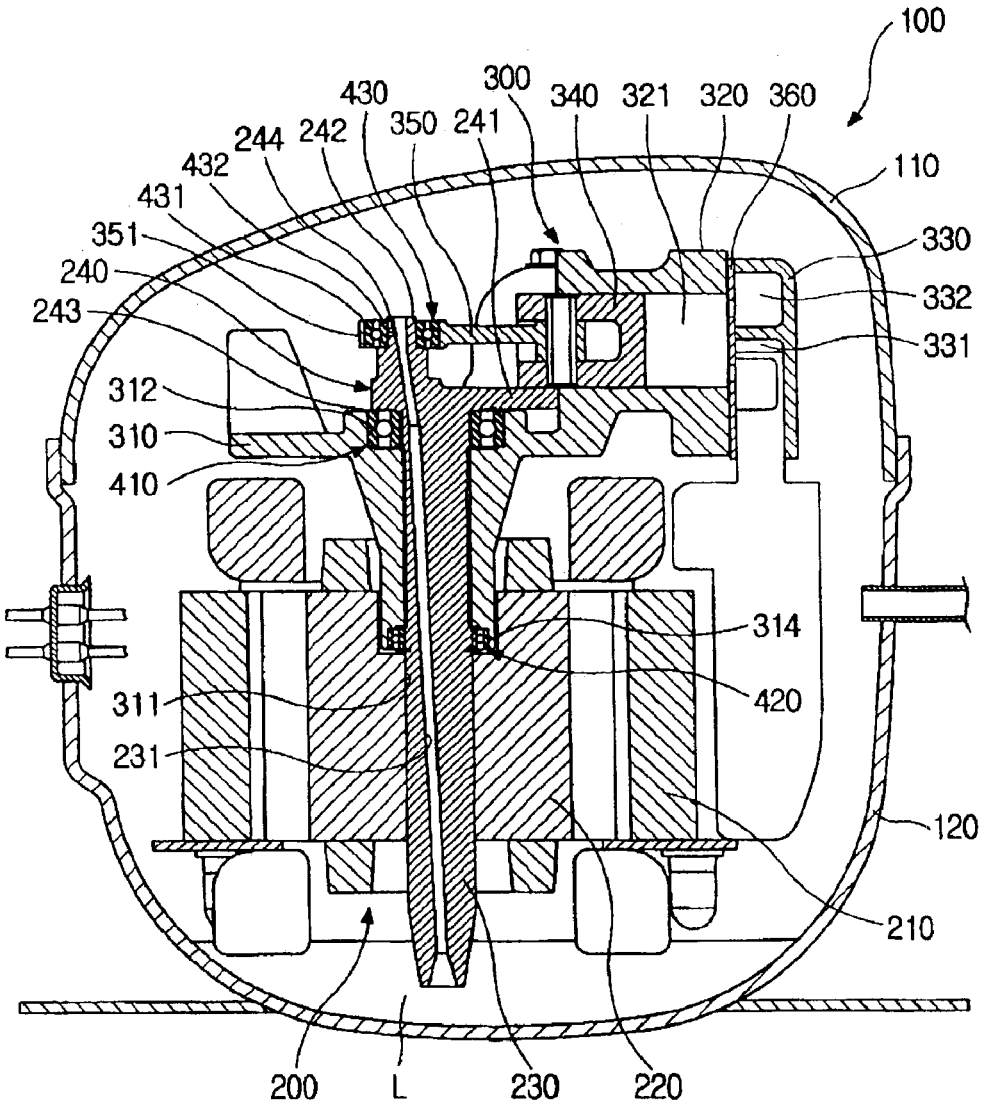
FIG. 9 is a side sectional view showing the construction of a hermetic reciprocating compressor, according to a fourth embodiment of the present invention.

FIG. 9 is a side sectional view showing the construction of a hermetic reciprocating compressor, according to a fourth embodiment of the present invention. As shown in the drawing, the hermetic reciprocating compressor according to the fourth embodiment includes first, second, and third radial bearings 410, 420 and 430 which are designed as self-aligning radial bearings.

Since the hermetic reciprocating compressor has the first, second, and third radial bearings 410, 420 and 430, it is possible to remarkably reduce friction between the rotating shaft 230 and the frame 310 and between the eccentric shaft 242 and the connecting rod 350. In addition, since the rotating shaft 230 self-aligns by the three radial bearings 410, 420 and 430, it is possible to reduce the losses caused by friction between the compression chamber 321 and the piston 340 and between the rotating shaft 230 and the shaft bore 311 of the frame 310.

As apparent from the above description, the present invention provides a hermetic reciprocating compressor, in which one or more radial bearings are installed in a junction between a rotating shaft and a shaft bore of a frame and/or a junction between an eccentric shaft and a connecting rod. It is thus possible to reduce friction between the parts of the hermetic reciprocating compressor, thereby reducing noise of the compressor and improving compression efficiency of the compressor.

In addition, the radial bearings used in the hermetic reciprocating compressor of the present invention are designed as self-aligning radial bearings. Therefore, even when a desired perpendicular arrangement of a compression chamber of a cylinder block relative to the shaft bore of the frame is not formed due to a mechanical tolerance of the frame, the rotating shaft self-aligns due to the self-aligning radial bearings, so that the hermetic reciprocating compressor reduces the losses caused by friction between the compression chamber and a piston and between the rotating shaft and the frame.

Although a preferred embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A hermetic reciprocating compressor, comprising:

a rotating shaft provided with an eccentric part at an upper portion thereof;

a drive unit to rotate the rotating shaft;

a frame having a shaft bore to receive the rotating shaft therein, with a first annular bearing seat formed around an upper edge of the shaft bore;

a cylinder block provided at an upper portion of the frame to define a compression chamber therein;

a piston received in the compression chamber to perform a rectilinear reciprocation in the compression chamber so as to compress a refrigerant, in response to a rotation of the eccentric part of the rotating shaft;

a first radial bearing seated in the first annular bearing seat of the frame to sustain both axial loads of the rotating shaft and horizontal loads acting in the rotating shaft due to the rectilinear reciprocation of the piston, the first radial bearing comprising a first outer race supported by the frame and a first inner race set around the rotating shaft;

a second annular bearing seat formed around a lower edge of the shaft bore;

a second radial bearing seated in the second annular bearing seat, the second radial bearing comprising a second outer race supported by the frame and a second inner race set around the rotating shaft;

a stop ring provided around the rotating shaft to support a lower surface of the second inner race of the second radial bearing; and a second spacing depression formed on an upper surface of the second annular bearing seat, such that an upper surface of the second inner race of the second radial bearing is spaced apart from the upper surface of the second annular bearing seat.

2. The hermetic reciprocating compressor according to claim 1, wherein the first radial bearing is a self-aligning radial bearing capable of allowing the rotating shaft to self-align due to a clearance angle of the first radial bearing.

3. The hermetic reciprocating compressor according to claim 1, wherein at least one first spring washer is provided at a position above or under the first radial bearing.

4. The hermetic reciprocating compressor according to claim 1, further comprising: a bearing support provided on a lower surface of the eccentric part to be supported by the first inner race of the first radial bearing; and a first spacing depression formed on a bottom surface of the first annular bearing seat, such that a lower surface of the first inner race is spaced apart from the bottom surface of the first annular bearing seat.

5. The hermetic reciprocating compressor according to claim 4, wherein the first inner race of the first radial bearing is set with friction around the rotating shaft, and the first outer race is securely fitted in the first annular bearing seat.

6. The hermetic reciprocating compressor according to claim 5, wherein a first upper spring washer having a predetermined elasticity is set in a junction between an upper surface of the first inner race and a lower surface of the bearing support.

7. The hermetic reciprocating compressor according to claim 4, wherein the first outer race of the first radial bearing is set with friction in the first annular bearing seat of the frame, and the first inner race is securely fitted over the rotating shaft.

8. The hermetic reciprocating compressor according to claim 7, wherein a first lower spring washer having a predetermined elasticity is set in a junction between a lower surface of the first outer race and the bottom surface of the first annular bearing seat.

9.The hermetic reciprocating compressor according to claim 1, wherein the second radial bearing is a self-aligning radial bearing capable of allowing the rotating shaft to self-align due to a clearance angle of the second radial bearing.

10. The hermetic reciprocating compressor according to claim 1, wherein a stepped part having a reduced diameter is provided on an outer surface of the rotating shaft at a predetermined section extending downward from the first annular bearing seat, so that a gap is secured between the outer surface of the rotating shaft and an inner surface of the shaft bore.

11. The hermetic reciprocating compressor according to claim 1, wherein a stepped part having a reduced diameter is provided on an outer surface of the rotating shaft at a predetermined section extending upward from the second annular bearing seat, so that a gap is secured between the outer surface of the rotating shaft and an inner surface of the shaft bore.

12. The hermetic reciprocating compressor according to claim 1, wherein the rotating shaft comprises: an oil path longitudinally formed in the rotating shaft from a lower end of the rotating shaft to the eccentric part so as to guide oil; and an oil outlet port formed in the eccentric part to feed the oil from the oil path to the eccentric part.

13. The hermetic reciprocating compressor according to claim 1, wherein a second spring washer having a predetermined elasticity is set in a junction between an upper surface of the second outer race of the second radial bearing and the upper surface of the second annular bearing seat.

14. The hermetic reciprocating compressor according to claim 1, further comprising: a connecting rod having a shaft guide at a first end thereof to be rotatably connected at the shaft guide to an eccentric shaft formed at an upper end of the eccentric part, and connected to the piston at a second end thereof, so that the connecting rod converts an eccentric rotation of the eccentric part into the rectilinear reciprocation of the piston; and a third radial bearing set in a junction between an outer surface of the eccentric shaft and an inner surface of the shaft guide of the connecting rod.

15. The hermetic reciprocating compressor according to claim 14, wherein the third radial bearing is a self-aligning radial bearing capable of allowing the rotating shaft to self-align due to a clearance angle of the third radial bearing.

16. The hermetic reciprocating compressor according to claim 14, wherein the rotating shaft comprises: an oil path longitudinally formed in the rotating shaft from a lower end of the rotating shaft to the eccentric part so as to guide oil; and an oil outlet port formed in the eccentric part to feed the oil from the oil path to the eccentric part.

17. The hermetic reciprocating compressor according to claim 14, wherein a stepped part having a reduced diameter is provided on an outer surface of the rotating shaft at a predetermined section extending downward from the first annular bearing seat, so that a gap is secured between the outer surface of the rotating shaft and an inner surface of the shaft bore.

18. The hermetic reciprocating compressor according to claim 14, wherein a stepped part having a reduced diameter is provided on an outer surface of the rotating shaft at a predetermined section extending upward from the second annular bearing seat, so that a gap is secured between the outer surface of the rotating shaft and an inner surface of the shaft bore.

* * * * *